US009330625B2

(12) United States Patent
Xu et al.

(10) Patent No.: US 9,330,625 B2
(45) Date of Patent: May 3, 2016

(54) MAINTENANCE CIRCUIT FOR DISPLAY PANEL

(71) Applicants: BOE TECHNOLOGY GROUP CO., LTD., Beijing (CN); BEIJING BOE DISPLAY TECHNOLOGY CO., LTD., Beijing (CN)

(72) Inventors: Yizhen Xu, Beijing (CN); Zhihua Sun, Beijing (CN); Xingji Wu, Beijing (CN); Jianming Wang, Beijing (CN); Liang Zhang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 28 days.

(21) Appl. No.: 14/366,208

(22) PCT Filed: May 10, 2013

(86) PCT No.: PCT/CN2013/075503

§ 371 (c)(1),
(2) Date: Jun. 17, 2014

(87) PCT Pub. No.: WO2014/139207

PCT Pub. Date: Sep. 18, 2014

(65) Prior Publication Data

US 2015/0269898 A1 Sep. 24, 2015

(30) Foreign Application Priority Data

Mar. 14, 2013 (CN) ..... 2013 1 0081681

(51) Int. Cl.
*G09G 3/36* (2006.01)

(52) U.S. Cl.
CPC ..... *G09G 3/3666* (2013.01); *G09G 3/3611* (2013.01); *G09G 2300/0426* (2013.01); *G09G 2320/04* (2013.01); *G09G 2330/08* (2013.01)

(58) Field of Classification Search
CPC ..... G09G 3/3648; G09G 3/3614; G09G 2230/08; G09G 2300/0426; G09G 3/3659; G09G 3/3677; G09G 3/3611; G09G 3/3688; G09G 2310/0205; G09G 2320/028
See application file for complete search history.

(56) References Cited

U.S. PATENT DOCUMENTS

2003/0103045 A1* 6/2003 Shiraishi ..... G02F 1/13452 345/204
2003/0112212 A1* 6/2003 Speirs ..... G09G 3/3688 345/95
2007/0040794 A1* 2/2007 Kwak ..... G02F 1/136259 345/100

FOREIGN PATENT DOCUMENTS

CN 1916700 A 2/2007
CN 101699551 A 4/2010
CN 102854648 A 1/2013

OTHER PUBLICATIONS

First Office Action issued by the Chinese Patent Office for Chinese Patent Application No. 201310081681.4 dated Jul. 2, 2014, 6pgs.

(Continued)

*Primary Examiner* — Olga Merkoulova
(74) *Attorney, Agent, or Firm* — Ladas & Parry LLP

(57) ABSTRACT

A maintenance circuit for a display panel, the display panel being divided by a plurality of source driver integrated circuits into a plurality of partitions(X1-X8) corresponding thereto, wherein each of source driver integrated circuits controls one partition, each four of adjacent partitions form a group of partitions, each of the maintenance circuit units comprises: a first maintenance line(RP1, RP3) and a second maintenance line(RP2, RP4) each provided with a half-turn shape surrounding around a group of partitions corresponding thereto; a first operational amplifier(OP1, OP3) and a second operational amplifier(OP2, OP4), the inverting input terminal of each of which is connected to an output terminal thereof and is connected to a corresponding maintenance line; and a plurality of resistors(R1-R8, L1-L8) selectively connected in accordance with two partitions of the group of the partitions to be maintained, so as to respectively import the two partitions to non-inverting input terminals of the two operational amplifiers via signals outputted from a corresponding source driver integrated circuits, and to feed the signals outputted from the two operational amplifiers back to the corresponding partitions.

10 Claims, 3 Drawing Sheets

(56) References Cited

OTHER PUBLICATIONS

English translation of First Office Action issued by the Chinese Patent Office for Chinese Patent Application No. 201310081681.4 dated Jul. 2, 2014, 6pgs.

International Search Report for International Application No. PCT/CN2013/075503, 11 pgs.

Second Office Action (Chinese Language) issued by the Chinese Patent Office for Chinese Patent Application No. 201310081681.4 dated Feb. 13, 2015, 4pgs.

English translation of Second Office Action issued by the Chinese Patent Office for Chinese Patent Application No. 201310081681.4 dated Feb. 13, 2015, 4pgs.

International Preliminary Report on Patentability Appln. No. PCT/CN2013/075503; Dated Sep. 15, 2015.

* cited by examiner

MAINTENANCE CIRCUIT FOR DISPLAY PANEL

CROSS REFERENCE TO RELATED APPLICATIONS

This application is based on International Application No. PCT/CN2013/075503 filed on May 10, 2013, which claims priority to Chinese National Application No. 201310081681.4 filed on Mar. 14, 2013. The entire contents of each and every foregoing application are incorporated herein by reference.

TECHNICAL FIELD

The present invention relates to a field of liquid crystal display, and particularly, to a maintenance circuit for a display panel.

BACKGROUND

A circuit break often exists in one or a plurality of columns or rows of lines of a display panel (such as TFT LCD). In order to maintain the circuit break, the TFT LCD panel is provided with maintenance lines therearound. When broken lines are found at time of final assembly of devices on the panel, the maintenance lines make the signals thereof bypass the circuit break.

FIG. 1 shows a schematic diagram of a conventional maintenance circuit for maintaining a TFT LCD panel using an operational amplifier.

FIG. 1 makes an explanation by taking a case where a broken point 2 occurs on a column line of the TFT LCD panel 1 as an example. As shown in FIG. 1, the broken point 2 is found at time of assembly of the TFT LCD panel 1, and at this moment, a panel maintenance line 5 is required to reroute a signal so as to bypass the broken point 2. Particularly, in FIG. 1, a signal outputted from a column driver 3 is connected to the panel maintenance line 5 via a panel maintenance buffer 4 formed by an operational amplifier so as to bypass the broken point 2, the output of the column driver 3 is transmitted to the other terminal of the broken column line through the panel maintenance line 5. The panel maintenance buffer 4 in FIG. 1 can be configured by the operational amplifier, the non-inverting input terminal of which is connected to an output of the column driver 3 and the inverting input terminal of which is connected to the output terminal, and this connection manner can allow the output magnification of the operational amplifier to be 1 and to be used as a voltage regulated current source. The output terminal of the operational amplifier is connected with a resistor 6 for separating the output of the column driver 3 from a capacitance on the column line to be maintained, so as to ensure stability of the buffer, and the value of the resistor 6 can be 20 to 100 ohm.

FIG. 2 is a diagram of a circuit construction showing how to maintain defective points in eight partitions X1 to X8 using four maintenance lines RP1 to RP4 each provided with a half-turn shape as known. Here, eight partitions X1 to X8 are respectively controlled by eight source driver integrated circuits (ICs) XD1 to XD8, and the maintenance line RP1 serves to maintain defective points (that is, broken points) inside the partitions X3 and X4; in other words, the maintenance line RP1 corresponds to partitions X3 and X4; the maintenance line RP2 corresponds to partitions X1 and X2; the maintenance line RP3 corresponds to partitions X5 and X6; the maintenance line RP4 corresponds to partitions X7 and X8.

As known, each of the maintenance lines corresponds to two partitions, and since each of the partitions is correspondingly arranged with one source driver integrated circuit, in principle, it needs eight maintenance lines each provided with a half-turn shape to be capable of maintaining eight partitions. However, considering a limitation to space on the TFT LCD panel, only four maintenance lines each provided with a half-turn shape can be arranged around the panel.

As shown in FIG. 2, when it is detected that there exists a defective point in the partitions X1 and X2, the maintenance line RP2 is employed to reroute the signal so as to bypass the broken point, that is, to make a connection between the output from the source driver integrated circuit corresponding to the partitions X1 and X2 and the maintenance line RP2 through the operational amplifier OP1. Similarly, when it is detected that there exists a defective point in the partitions X3 and X4, the maintenance line RP1 is employed to reroute the signal so as to bypass broken point, that is, to make a connection between the output from the driver integrated circuit corresponding to the partitions X3 and X4 and the maintenance line RP1 through the operational amplifier OP2. When it is detected that there exists a defective point in the partitions X5 and X6, the maintenance line RP3 is employed to reroute the signal so as to bypass broken point, that is, to make a connection between the output from the driver integrated circuit corresponding to the partition X5 and X6 and the maintenance line RP3 through the operational amplifier OP4. When it is detected that there exists a defective point in the partitions X7 and X8, the maintenance line RP4 is employed to reroute the signal so as to bypass broken point, that is, to make a connection between the output from the driver integrated circuit corresponding to the partitions X7 and X8 and the maintenance line RP4 through the operational amplifier OP3. The specific connection manner of the operational amplifiers OP1 to OP4 in FIG. 2 is same as that of the operational amplifier as the panel maintenance buffer 4 shown in FIG. 1.

Since only four operational amplifiers OP1 to OP4 are included in the maintenance circuit as known, this kind of circuit can only detect four partitions (X1-X2, X3-X4, X5-X6, X7-X8) at the same time; that is, the operational amplifier OP1 can only maintain defective points in one partition of the partitions X1 and X2, the operational amplifier OP2 can only maintain defective points in one partition of the partitions X3 and X4, the operational amplifier OP3 can only maintain defective points in one partition of the partitions X7 and X8, and the operational amplifier OP4 can only maintain defective points in one partition of the partitions X5 and X6. If defective points exist in both of the partition X1 and X2, the defective points in partitions X1 and X2 can not be maintained at the same time.

SUMMARY

An embodiment of the present invention is intended to provide a maintenance circuit for a display panel capable of rearranging couple points among respective partitions, operational amplifiers and maintenance lines using the resistors while maintaining the number of operational amplifiers and the number of the maintenance lines used currently unchanged, so that any two partitions of all the partitions in the whole display panel can be maintained simultaneously.

For this reason, an embodiment of the present invention provides a maintenance circuit for a display panel for maintaining broken lines occurred in a TFT-LCD panel, the display panel being divided by a plurality of source driver integrated circuits into a plurality of partitions corresponding thereto, wherein each of source driver integrated circuits controls one partition, each four of adjacent partitions form a group of partitions, the maintenance circuit for the display panel comprising a plurality of maintenance circuit units independent of each other, each of the maintenance circuit units corresponding to a group of partitions and serving to maintain this group of the partitions, each of the maintenance circuit units comprising: a first maintenance line and a second maintenance line each provided with a half-turn shape surrounding around a group of partitions corresponding thereto; a first operational amplifier and a second operational amplifier, the inverting input terminal of each of which is connected to an output thereof and is connected to a corresponding maintenance line; and a plurality of resistors selectively connected in accordance with two partitions of the group of the partitions to be maintained, so as to respectively import the two partitions to be maintained to non-inverting input terminals of the two operational amplifiers via signals outputted from corresponding source driver integrated circuits, and to feed the signals outputted from the two operational amplifiers back to the corresponding partitions.

Optionally, each of the maintenance circuit units comprises eight resistors of a first resistor, a second resistor, a third resistor, a fourth resistor, a fifth resistor, a sixth resistor, a seventh and an eighth resistor, and each group of the partitions comprises a first partition, a second partition, a third partition and a fourth partition; the first partition is connected to the non-inverting input terminal of the first operational amplifier through a first signal output terminal imported from the source driver integrated circuit corresponding thereto; the second partition is connected to a second terminal of the third resistor and a second terminal of the fourth resistor through a second signal output terminal imported from the source driver integrated circuit corresponding thereto, a first terminal of the third resistor is connected to a non-inverting input terminal of the first operational amplifier, and the first terminal of the fourth resistor is connected to the non-inverting input terminal of the second operational amplifier; the third partition is connected to a second terminal of the first resistor and a second terminal of the second resistor through a third signal output terminal imported from the source driver integrated circuit corresponding thereto, a first terminal of the first resistor is connected to a non-inverting input terminal of the second operational amplifier, and a first terminal of the second resistor is connected to the non-inverting input terminal of the first operational amplifier; the fourth partition is connected to the non-inverting input terminal of the second operational amplifier through a fourth signal output terminal imported from a source driver integrated circuit corresponding thereto; an output terminal of the first operational amplifier is connected to the second maintenance line, and connected to a first signal input terminal which is import to the first partition through a corresponding source driver integrated circuit; an output terminal of the second operational amplifier is connected to the first maintenance line, and connected to a fourth signal input terminal which is import to the fourth partition through a corresponding source driver integrated circuit; a first terminal of the fifth resistor is connected to the second signal input terminal which is import to the second partition through a corresponding source driver integrated circuit, and a second terminal of the fifth resistor is connected to the output terminal of the first operational amplifier; a second terminal of the sixth resistor is connected to the output terminal of the first operational amplifier, and a first terminal of the sixth resistor is connected to a third signal input terminal which is import to the third partition through a corresponding source driver integrated circuit; a first terminal of the seventh resistor is connected to the output terminal of the second operational amplifier, and a second terminal of the seventh resistor is connected to the third signal input terminal; and a first terminal of the eighth resistor is connected to the output terminal of the second operational amplifier, and a second terminal of the eighth resistor is connected to the second signal input terminal Optionally, two partitions of each group of the partitions can be maintained in such a way in which the two partitions are respectively imported to two operational amplifiers by two resistors via signals outputted from corresponding source driver integrated circuits respectively, and outputs of the two operational amplifiers are respectively fed back to corresponding partitions by another two resistors.

Optionally, two partitions of each group of the partitions can be maintained in such a way in which the two partitions are directly imported to two operational amplifiers respectively via signals outputted from corresponding source driver integrated circuits, and outputs of the two operational amplifiers are directly fed back to corresponding partitions respectively.

Optionally, two partitions of each group of the partitions can be maintained in such a way in which one partition of the two partitions is directly imported to one operational amplifier via a signal outputted from a corresponding source driver integrated circuit and output of this operational amplifier is directly fed back to this partition, while another partition of the two partitions is imported to another operational amplifier by a resistor via a signal outputted from a corresponding source driver integrated circuit, and output of the another operational amplifier is fed back to the another partition via the resistor.

Optionally, resistance value of each of the plurality of the resistors is zero ohm.

Optionally, the plurality of maintenance circuit units contained in the maintenance circuit for the display panel is identical.

For the problem of the prior art in which one operational amplifier is shared between two partitions of a group of partitions formed by the four partitions so that only one partition of the two partitions sharing one operational amplifier can be maintained at each time in establishment of connection with the maintenance lines, the embodiments of the present invention provide a solution of sharing two operational amplifiers among a group of partitions formed by four partitions. As known, when break points exist in both of the two adjacent partitions, if those two adjacent partitions share one operational amplifier, the two adjacent partitions can not be maintained simultaneously. In the embodiments of the present invention, it is possible to share two operational amplifiers between a group of partitions formed by four partitions by rearranging connections between the partitions and the operational amplifiers using the resistors, and therefore, when break points exist in both of the two adjacent partitions, it is possible to rearrange the couple of the partitions and the operational amplifiers using the resistors, so as to realize simultaneous maintenance for any two partitions in the four partitions of a group of the partitions, which comprises simultaneous maintenance for two adjacent partitions.

BRIEF DESCRIPTION OF THE DRAWINGS

With the following description associated with the appended drawings, the embodiments of the present invention will be more readily understood and the advantages and features thereof will be more readily understood, in which.

DETAILED DESCRIPTION

In order to make contents of embodiments of the present invention more clearly and easily understood, hereinafter, the specific embodiments of the present invention will be described in detail with reference to appended drawings. In the embodiments of the present invention, by way of example, a maintenance circuit for a display panel provided by the embodiments of the present invention will be explained; however, the embodiments of the present invention are not limited to the disclosed specific forms of the embodiments. Those skilled in art can make modifications and variations to the embodiments of the present invention in accordance with the disclosed contents of the embodiments of the present invention, and those modifications and variations should also fall into the protection scope of the present invention defined by the claims.

The embodiments of the present invention makes an improvement to the maintenance circuit as known in which four maintenance lines each provided with a half-turn shape around the display panel are employed to maintain broken lines occurring in eight partitions of the display panel, and provides a new maintenance circuit for the display panel.

On the basis of the maintenance circuit as known in which four maintenance lines each provided with a half-turn shape are employed to maintain the display panel, the new maintenance circuit for the display panel provided by the embodiments of the present invention divides four adjacent partitions into a group of partitions, rearranges couple points among outputs of respective partitions of each group of the partitions, operational amplifiers and maintenance lines using the resistors without changing the number of employed operational amplifiers, so that one operational amplifier is not limited to be shared by two partitions any more, but can be shared by four partitions, and thus as compared with the prior art, any two partitions of a group of the partitions can be maintained simultaneously without change of the number of employed operational amplifiers.

Figure 3:
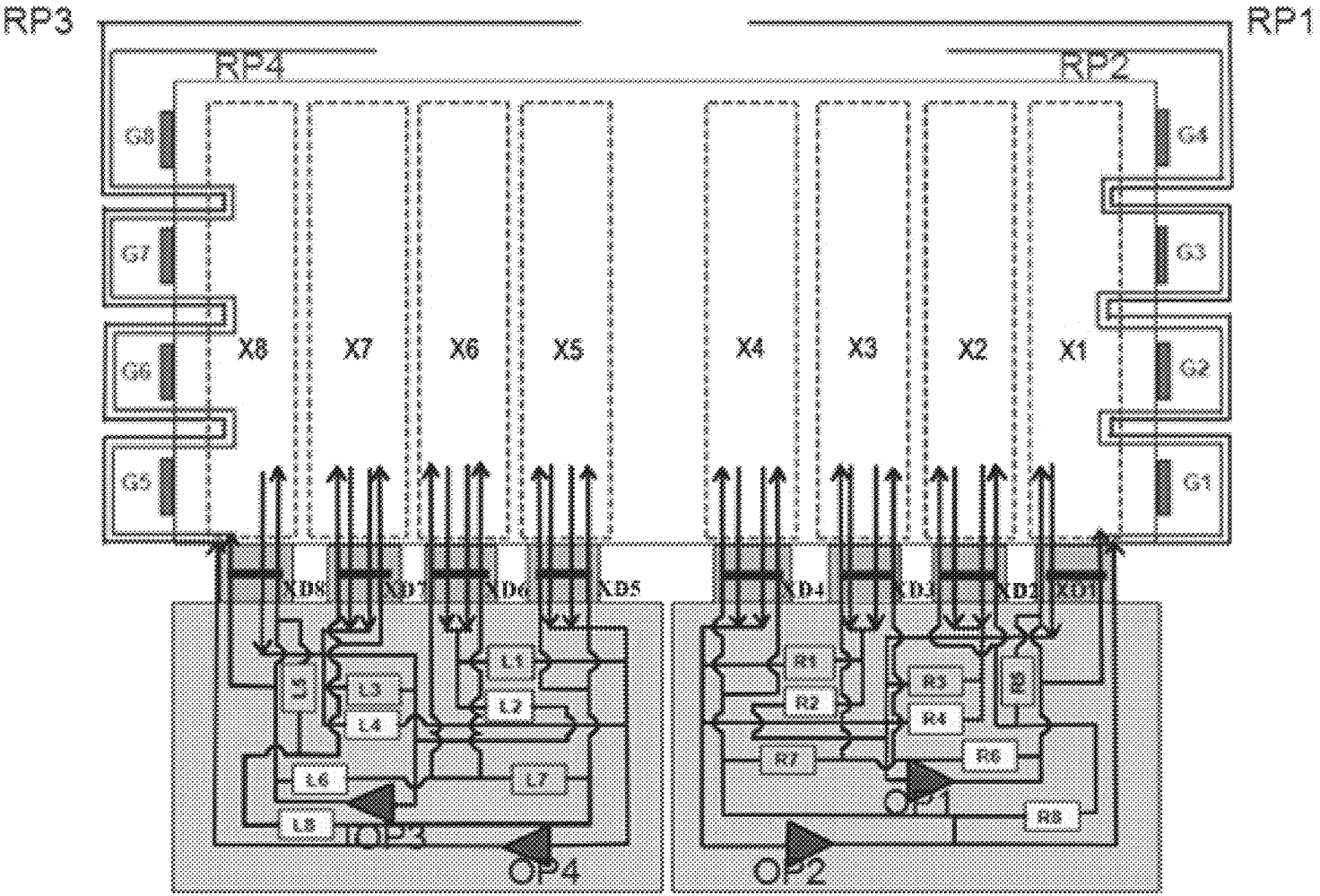
FIG. 3 shows a schematic diagram of a circuit construction of a maintenance circuit for the TFT LCD panel according to an embodiment of the present invention.

FIG. 3 shows a schematic diagram of a circuit construction of the maintenance circuit for the TFT LCD panel according to one embodiment of the present invention.

Figure 2:
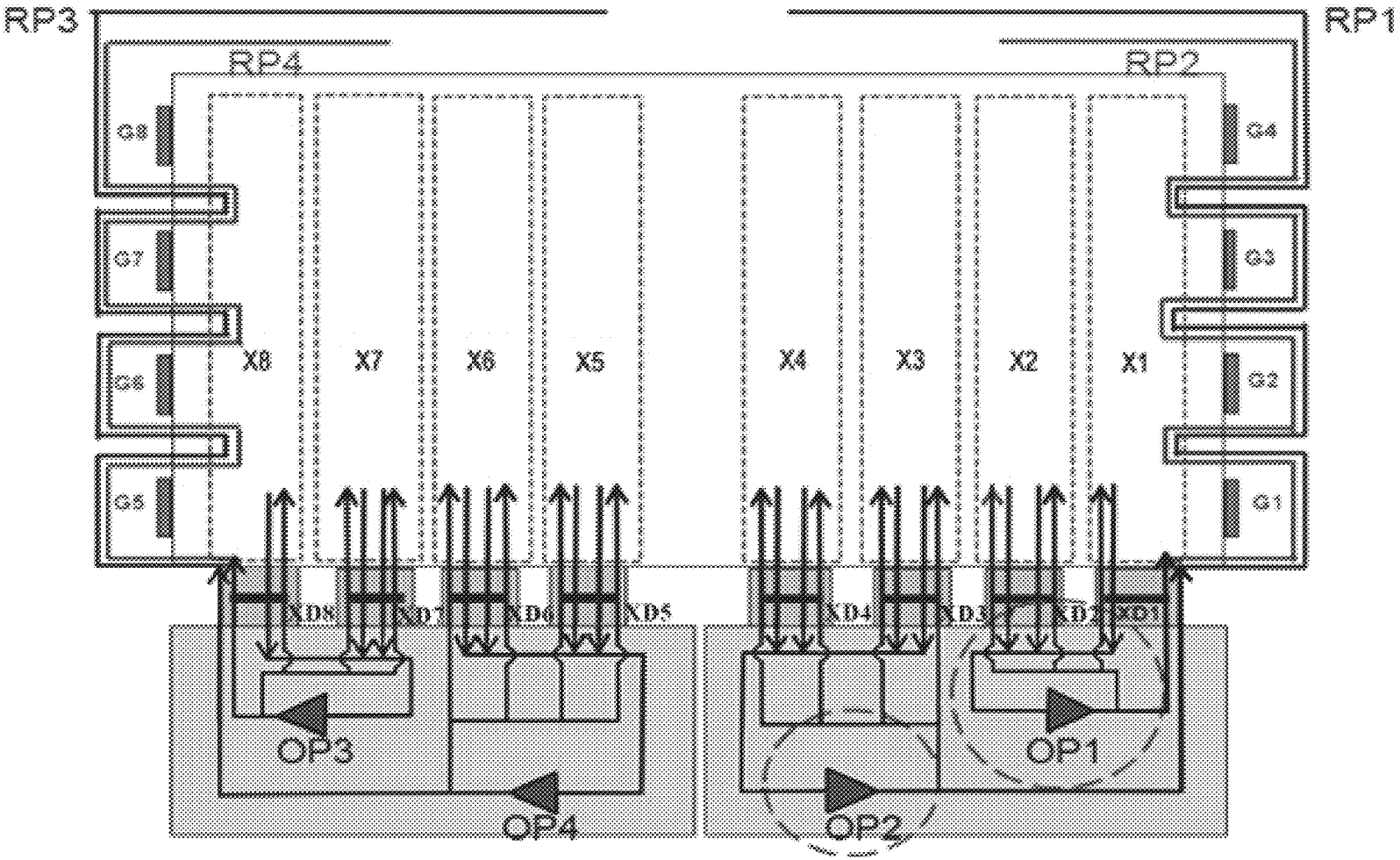
FIG. 2 is a schematic diagram of a circuit construction showing how to maintain defective points in eight partitions X1 to X8 using four maintenance lines RP1 to RP4 each provided with a half-turn shape as known.

As compared with the maintenance circuit as known shown in FIG. 2 for maintaining circuit break occurred in the TFT LCD panel, the maintenance circuit for the TFT LCD panel of the embodiment of the present invention comprises a plurality of maintenance circuit units, each of which serves to maintain a group of partitions formed by four partitions, and the maintenance circuit unit for each group of the partitions is independent of each other. Optionally, these maintenance circuit units can be identical, and it is also possible to arrange different maintenance circuit units for different group of the partitions as necessary. Particularly, in addition to four operational amplifiers OP1 to OP4, the maintenance circuit for the TFT LCD panel of the embodiment of the present invention comprises resistors R1 to R8 and resistors L1 to L8.

As shown in FIG. 3, for the group of the partitions formed by the partitions X1 to X4, the maintenance circuit unit corresponding thereto comprises resistor R1, resistor R2, resistor R3, resistor R4, resistor R5, resistor R6, resistor R7 and resistor R8, operational amplifier OP1 and operational amplifier OP2, and maintenance lines RP1 and RP2. Here, the partition X1 is connected to a non-inverting input terminal of the operational amplifier OP1 through a first signal output terminal imported from a source driver integrated circuit XD1 corresponding thereto; the partition X2 is connected to a second terminal of the resistor R3 and a second terminal of the resistor R4 through a second signal output terminal imported from the source driver integrated circuit XD2 corresponding thereto, a first terminal of the resistor R3 is connected to a non-inverting input terminal of the operational amplifier OP1, and the first terminal of the resistor R4 is connected to a non-inverting input terminal of the operational amplifier OP2; the partitions X3 is connected to a second terminal of the resistor R1 and a second terminal of the resistor R2 through a third signal output terminal imported from the source driver integrated circuit XD3 corresponding thereto, a first terminal of the resistor R1 is connected to a non-inverting input terminal of the operational amplifier OP2, and the first terminal of the resistor R2 is connected to a non-inverting input terminal of the operational amplifier OP1; the partition X4 is connected to a non-inverting input terminal of the operational amplifier OP2 through a fourth signal output terminal imported from a source driver integrated circuit XD4 corresponding thereto; an output terminal of the operational amplifier OP1 is connected to the maintenance line RP2, and connected to a first signal input terminal which is import to the partition X1 through a corresponding source driver integrated circuit XD1; an output terminal of the operational amplifier OP2 is connected to the maintenance line RP1, and connected to a fourth signal input terminal which is import to the partition X4 through a corresponding source driver integrated circuit XD4; a first terminal of the resistor R5 is connected to the second signal input terminal which is import to the partition X2 through a corresponding source driver integrated circuit XD2, and a second terminal of the resistor R5 is connected to the output terminal of the operational amplifier OP1; a second terminal of the resistor R6 is connected to the output terminal of the operational amplifier OP1, and the first terminal of the resistor R6 is connected to a third signal input terminal which is import to the partition X3 through a corresponding source driver integrated circuit XD3; the first terminal of the resistor R7 is connected to the output terminal of the operational amplifier OP2, and the second terminal of the resistor R7 is connected to the third signal input terminal; and the first terminal of the resistor R8 is connected to the output terminal of the operational amplifier OP2, and the second terminal of the resistor R8 is connected to the second signal input terminal In the above circuit construction of the maintenance circuit according to the embodiment of the present invention, the signal outputted from partition X1 through the source driver integrated circuit XD1 is directly outputted to the maintenance line RP2 via the operational amplifier OP 1; the signal outputted from the partition X2 through the source driver integrated circuit XD2 can be outputted to the maintenance line RP2 sequentially through resistor R3 and operational amplifier OP1, or can be outputted to the maintenance line RP1 sequentially through the resistor R4 and the operational amplifier OP2; the signal outputted from the partition X3 through the source driver integrated circuit XD3 can be outputted to the maintenance line RP1 sequentially through resistor R1 and operational amplifier OP2, or can be outputted to the maintenance line RP2 sequentially through the resistor R2 and the operational amplifier OP1; and the signal outputted from the partition X4 through the source driver integrated circuit XD4 can be directly outputted to the maintenance line RP1 via the operational amplifier OP2.

When the TFT LCD panel is maintained, in addition to connecting the signals outputted from the partitions to the maintenance lines through the operational amplifiers as described above, it needs to feed the signals outputted from the operational amplifiers to the respective partitions, and in this way, the maintain for the TFT LCD panel can be realized.

As shown in FIG. 3, the signal outputted from the OP2 can be directly outputted to the partition X4; the signal outputted from the OP2 can also be outputted to the partition X2 via the resistor R8; the signal outputted from the OP2 can also be outputted to the partitions X3 via the resistor R7. And the signal outputted from the OP1 can be directly outputted to X1; the signal outputted from the OP1 can also be outputted to the partition X2 via the resistor R5; the signal outputted from the OP1 can also be outputted to the partitions X3 via the resistor R6.

As can be seen from the above, when it needs to maintain the partition X1 and the partition X2 simultaneously, the signal outputted from the partition X1 can be connected to the maintenance line RP2 through the operational amplifier OP1 directly, and for the partition X2, the signal outputted therefrom can be coupled to the operational amplifier OP2 using the resistor R4 and then coupled to the maintenance line RP1; and for the partition X1, the signal outputted from the operational amplifier OP1 can be fed back to the partition X1 directly; for the partition X2, the signal outputted from the operational amplifier OP2 can be fed back to the partition X2 via the resistor R8.

From the above description, it can be seen that, for the group of the partitions formed by four partitions X1 to X4, when the adjacent partitions X1 and X2 thereof are maintained, it needs to connect resistors R4 and R8. As compared with a case as known shown in FIG. 1 where the partitions X1 and X2 can not be maintained simultaneously, in the embodiment of the present invention, it is possible to share two operational amplifiers in a group of partitions using the resistors, and thus it is possible to simultaneously maintain two adjacent partitions, which can not be maintained simultaneously in the prior art.

Similarly, when it needs to maintain the partitions X2 and X3, for the partition X2, it is possible that the signal outputted therefrom is coupled to the operational amplifier OP1 using the resistor R3, and then is coupled to the maintenance line RP2 via the operational amplifier OP1; for the partitions X3, it is possible for the signal outputted therefrom to be coupled to the operational amplifier OP2 using the resistor R1, and then to be coupled to the maintenance line RP1 via the operational amplifier OP2; and for the partition X2, it is possible for the signal outputted from the operational amplifier OP1 to be fed back to the partition X2 using the resistor R5; for the partitions X3, it is possible for the signal outputted from the operational amplifier OP2 to be fed back to the partitions X3 using resistor R7.

From the above analysis, it can be seen that it needs to connect the resistors R1, R3, R5 and R7 when it needs to maintain the partitions X2 and X3 simultaneously.

Similarly, when it needs to maintain the partitions X3 and X4 simultaneously, it needs to connect the resistors R2 and R6, and when it needs to maintain the partitions X1 and X4 simultaneously, it does not need to connect any one of the resistors.

For another group of partitions formed by the partitions X5 and X8, similar to the group of partitions formed by the partitions X1 to X4, the maintenance circuit for this group of the partitions also comprises two operational amplifiers OP3 and OP4, as well as resistors L1 to L8. The connection manner of the maintenance circuit is same as that of the maintenance circuit for the group of partitions formed by the partitions X1 to X4.

Here, when it needs to maintain the partitions X7 and X8 simultaneously, it needs to connect the resistors L4 and L8; when it needs to maintain the partitions X7 and X6 simultaneously, it needs to connect the resistors L1, L3, L5 and L7; when it needs to maintain the partitions X6 and X5 simultaneously, it needs to connect the resistors L2 and L6; and when it needs to maintain the X5 and X8 simultaneously, it does not need to connect any of the resistors.

Figure 1:
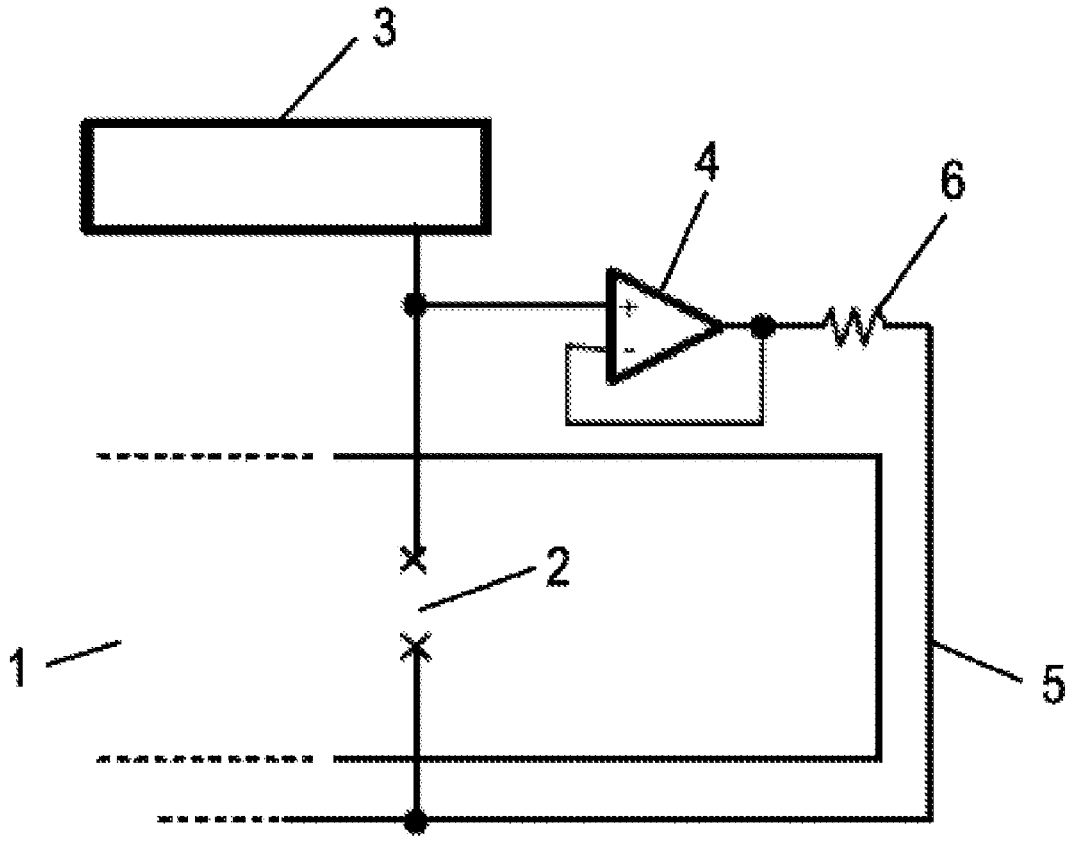
Fig. 1 (Prior Art)
FIG. 1 shows a schematic diagram of a conventional maintenance circuit for maintaining a TCT LCD panel using an operational amplifier.

The connection manner of the operational amplifiers OP1 to OP4 in the maintenance circuit shown in FIG. 3 is same as that of the operational amplifiers as the panel maintenance buffer 4 shown in FIG. 1; that is, in the embodiment of the present invention, the operational amplifiers OP1 to OP4 are used as a voltage regulated current source, and the magnification thereof is equal to 1. Particularly, the non-inverting input terminals of the operational amplifiers OP1 to OP4 are connected to corresponding resistors, or connected to outputs of the corresponding source driver integrated circuits; the inverting input terminals thereof are connected to the output terminals of the respective operational amplifiers OP1 to OP4 to be further connected to the maintenance lines; the operational amplifier connected in this manner constitutes the voltage regulated current source with a magnification of 1. The operational amplifier of the embodiments of the present invention can employ the operational amplifier with a model of IML2111. In addition, since the resistors of the embodiments of the present invention are configured to couple the signals outputted from respective partitions to the operational amplifier as necessary and couple the outputs of the operational amplifiers back to the respective partitions, it is possible to choose resistors with resistance value of zero ohm.

For the problem of the prior art shown in FIG. 2 in which one operational amplifier can only be shared between two adjacent partitions of a group of partitions formed by the four partitions and thus those two partitions which share the one operational amplifier can not be maintained simultaneously, the embodiments of the present invention provide a technical solution of rearranging the couple points between the partitions and the operational amplifiers to share two operational amplifiers between a group of partitions formed by the four partitions, so as to be capable of realizing couple of respective partitions and corresponding operational amplifiers via the resistors when it needs to maintain any two partitions of a group of partitions formed by four partitions; that is, it is possible to import the signals outputted from the partitions to the operational amplifiers via the resistors, while it is also possible to feed the signals outputted from the operational amplifiers back to the partitions via the resistors. Hence, as compared with the prior art, it is possible to maintain any two partitions of a group of partitions formed by four partitions simultaneously.

Finally, it should be explained that, the above embodiments are only intended to explain the technical solution of the embodiments of the present invention, and are not a limitation thereto; although the embodiments of the present invention have been explained in detail with reference to the optional embodiments, those skilled in the art should understand that, modifications and equivalent alternations may be made to the technical solution of the embodiments of the present invention without departing from the spirit and scope of the technical solution of the embodiments of the present invention.

What is claimed is:

1. A maintenance circuit for a display panel for maintaining broken lines occurred in the display panel, the display panel being divided by a plurality of source driver integrated circuits into a plurality of partitions corresponding thereto, wherein each of the source driver integrated circuits is configured to control one partition, each four of adjacent the partition are configured to form a group of partitions, the maintenance circuit for the display panel comprises a plurality of maintenance circuit units independent of each other, each of the maintenance circuit units corresponds to a group of partitions and is configured to maintain this group of the partitions, and each of the maintenance circuit units comprises:

a first maintenance line and a second maintenance line surrounding around a group of partitions corresponding thereto;

a first operational amplifier and a second operational amplifier, an inverting input terminal of each of which is connected to an output thereof and is connected to a corresponding maintenance line; and a plurality of resistors selectively connected in accordance with two partitions of the group of the partitions to be maintained, so as to respectively import the two partitions to be maintained to non-inverting input terminals of the two operational amplifiers via signals outputted from corresponding source driver integrated circuits respectively, and to feed signals outputted from the two operational amplifiers back to the corresponding partitions;

wherein each of the maintenance circuit units comprises a first resistor, a second resistor, a third resistor and a fourth resistor, and each group of the partitions comprises a first partition, a second partition, a third partition and a fourth partition;

the first partition is connected to the non-inverting input terminal of the first operational amplifier through a first signal output terminal imported from the source driver integrated circuit corresponding thereto;

the second partition is connected to a second terminal of the third resistor and a second terminal of the fourth resistor through a second signal output terminal imported from the source driver integrated circuit corresponding thereto, a first terminal of the third resistor is connected to a non-inverting input terminal of the first operational amplifier, and the first terminal of the fourth resistor is connected to the non-inverting input terminal of the second operational amplifier;

the third partition is connected to a second terminal of the first resistor and a second terminal of the second resistor through a third signal output terminal imported from the source driver integrated circuit corresponding thereto, a first terminal of the first resistor is connected to a non-inverting input terminal of the second operational amplifier, and a first terminal of the second resistor is connected to the non-inverting input terminal of the first operational amplifier;

the fourth partition is connected to the non-inverting input terminal of the second operational amplifier through a fourth signal output terminal imported from a source driver integrated circuit corresponding thereto;

an output terminal of the first operational amplifier is connected to the second maintenance line; and an output terminal of the second operational amplifier is connected to the first maintenance line.

2. The maintenance circuit for the display panel according to claim 1, wherein each of the maintenance circuit units further comprises a fifth resistor, a sixth resistor, a seventh and an eighth resistor, wherein the output terminal of the first operational amplifier is further connected to a first signal input terminal which is import to the first partition through a corresponding source driver integrated circuit;

the output terminal of the second operational amplifier is further connected to a fourth signal input terminal which is import to the fourth partition through a corresponding source driver integrated circuit;

a first terminal of the fifth resistor is connected to the second signal input terminal which is import to the second partition through a corresponding source driver integrated circuit, and a second terminal of the fifth resistor is connected to the output terminal of the first operational amplifier;

a second terminal of the sixth resistor is connected to the output terminal of the first operational amplifier, and a first terminal of the sixth resistor is connected to a third signal input terminal which is import to the third partition through a corresponding source driver integrated circuit;

a first terminal of the seventh resistor is connected to the output terminal of the second operational amplifier, and a second terminal of the seventh resistor is connected to the third signal input terminal; and a first terminal of the eighth resistor is connected to the output terminal of the second operational amplifier, and a second terminal of the eighth resistor is connected to the second signal input terminal.

3. The maintenance circuit for the display panel according to claim 1, wherein two partitions of each group of the partitions are configured to be maintained in such a way in which the two partitions are respectively imported to two operational amplifiers by two resistors via signals outputted from corresponding source driver integrated circuits respectively, and outputs of the two operational amplifiers are respectively fed back to corresponding partitions by another two resistors.

4. The maintenance circuit for the display panel according to claim 1, wherein two partitions of each group of the partitions are configured to be maintained in such a way in which the two partitions are directly imported to two operational amplifiers respectively via signals outputted from corresponding source driver integrated circuits respectively, and outputs of the two operational amplifiers are directly fed back to corresponding partitions respectively.

5. The maintenance circuit for the display panel according to claim 1, wherein two partitions of each group of the partitions are configured to be maintained in such a way in which one partition of the two partitions is directly imported to one operational amplifier via a signal outputted from a corresponding source driver integrated circuit and output of this operational amplifier is directly fed back to this partition, while another partition of the two partitions is imported to another operational amplifier by a resistor via a signal outputted from a corresponding source driver integrated circuit, and an output of the another operational amplifier is fed back to the another partition via another resistor.

6. The maintenance circuit for the display panel according to claim 1, wherein resistance value of each of the plurality of the resistors is zero ohm.

7. The maintenance circuit for the display panel according to claim 1, wherein the plurality of maintenance circuit units contained in the maintenance circuit for the display panel is identical.

8. The maintenance circuit for the display panel according to claims 2, wherein resistance value of each of the first resistor, the second resistor, the third resistor, the fourth resistor, the fifth resistor, the sixth resistor, the seventh and the eighth resistor is zero ohm.

9. The maintenance circuit for the display panel according to claims 3, wherein resistance value of each of the two resistors and that of each of the another two resistors are zero ohm.

10. The maintenance circuit for the display panel according to claims 5, wherein resistance value of each of the resistor and the another resistor is zero ohm.

* * * * *